US008844931B2

(12) United States Patent
Blaha et al.

(10) Patent No.: US 8,844,931 B2
(45) **Date of Patent: *Sep. 30, 2014**

(54) CARD SHUFFLER WITH GRAVITY FEED SYSTEM FOR PLAYING CARDS

(71) Applicant: Shuffle Master GmbH & Co KG, Vienna (AT)

(72) Inventors: Ernst Blaha, Tullnerbach (AT); Peter Krenn, Neufeld (AT)

(73) Assignee: Shuffle Master GmbH & Co KG, Vienna (AT)

( * ) Notice: Subject to any disclaimer, the term of this patent is extended or adjusted under 35 U.S.C. 154(b) by 0 days.

This patent is subject to a terminal disclaimer.

(21) Appl. No.: 14/042,441

(22) Filed: Sep. 30, 2013

(65) Prior Publication Data

US 2014/0103607 A1 Apr. 17, 2014

Related U.S. Application Data

(63) Continuation of application No. 13/540,434, filed on Jul. 2, 2012, now Pat. No. 8,544,848, and a continuation of application No. 13/171,360, filed on Jun. 28, 2011, now Pat. No. 8,210,536, and a continuation of application No. 12/498,297, filed on Jul. 6, 2009, now Pat. No. 7,967,294, and a continuation of application No. 11/389,524, filed on Mar. 24, 2006, now Pat. No. 7,556,266.

(51) Int. Cl.
*A63F 1/12* (2006.01)

(52) U.S. Cl.
CPC ..... *A63F 1/12* (2013.01)
USPC ..... 273/149 R; 273/149 P

(58) Field of Classification Search
USPC ..... 273/149 R, 149 P
See application file for complete search history.

(56) References Cited

U.S. PATENT DOCUMENTS

| | | | |
|---|---|---|---|
| 1,885,276 | A | 11/1932 | McKay |
| 2,016,030 | A | 10/1935 | Woodruff et al. |
| 2,159,958 | A | 5/1939 | Sachs |
| 2,717,782 | A | 9/1955 | Droll |
| 4,497,488 | A | 2/1985 | Plevyak et al. |
| 4,512,580 | A | 4/1985 | Matviak |
| 4,586,712 | A | 5/1986 | Lorber et al. |
| 4,659,082 | A | 4/1987 | Greenberg |
| 4,667,959 | A | 5/1987 | Pfeiffer et al. |
| 4,832,342 | A | 5/1989 | Plevyak |
| 4,969,648 | A | 11/1990 | Hollinger et al. |
| 5,240,140 | A | 8/1993 | Huen |

(Continued)

FOREIGN PATENT DOCUMENTS

| | | |
|---|---|---|
| EP | 0 777 514 | 2/2000 |
| JP | 10-063933 A | 3/1998 |

(Continued)

*Primary Examiner* — Benjamin Layno
(74) *Attorney, Agent, or Firm* — TraskBritt

(57) ABSTRACT

A card feed system for feeding cards into a card handling system. The card feed system includes a card input compartment with a playing card support surface, a front wall, a rear wall and two side walls. The playing card support surface slopes toward the front wall at an angle between 12 degrees and 22 degrees. A slot is provided in the front wall to allow single cards to pass into the card handling system. The card feed system also includes a card moving system to advance cards through the slot.

13 Claims, 12 Drawing Sheets

(56) References Cited

U.S. PATENT DOCUMENTS

| | | | |
|---|---|---|---|
| 5,275,411 | A | 1/1994 | Breeding |
| 5,431,399 | A | 7/1995 | Kelley et al. |
| 5,676,372 | A | 10/1997 | Sines et al. |
| 5,683,085 | A | 11/1997 | Johnson et al. |
| 5,692,748 | A | 12/1997 | Frisco et al. |
| 5,695,189 | A | 12/1997 | Breeding et al. |
| 5,722,893 | A | 3/1998 | Hill et al. |
| 5,944,310 | A | 8/1999 | Johnson et al. |
| 5,989,122 | A | 11/1999 | Roblejo et al. |
| 6,019,368 | A | 2/2000 | Sines et al. |
| 6,068,258 | A | 5/2000 | Breeding et al. |
| 6,139,014 | A | 10/2000 | Breeding et al. |
| 6,149,154 | A | 11/2000 | Grauzer et al. |
| 6,165,069 | A | 12/2000 | Sines et al. |
| 6,254,096 | B1 | 7/2001 | Grauzer et al. |
| 6,267,248 | B1 | 7/2001 | Johnson et al. |
| 6,270,404 | B2 | 8/2001 | Sines et al. |
| 6,299,534 | B1 | 10/2001 | Breeding et al. |
| 6,325,373 | B1 | 12/2001 | Breeding et al. |
| 6,454,266 | B1 | 9/2002 | Breeding et al. |
| 6,568,678 | B2 | 5/2003 | Breeding et al. |
| 6,582,301 | B2 | 6/2003 | Hill |
| 6,588,750 | B1 | 7/2003 | Grauzer et al. |
| 6,588,751 | B1 * | 7/2003 | Grauzer et al. ..... 273/149 R |
| 6,629,889 | B2 | 10/2003 | Mothwurf |
| 6,637,622 | B1 | 10/2003 | Robinson |
| 6,651,985 | B2 | 11/2003 | Sines et al. |
| 6,655,684 | B2 | 12/2003 | Grauzer et al. |
| 6,659,460 | B2 | 12/2003 | Blaha et al. |
| 6,663,490 | B2 | 12/2003 | Soltys et al. |
| 6,688,979 | B2 | 2/2004 | Soltys et al. |
| 6,712,696 | B2 | 3/2004 | Soltys et al. |
| 6,722,974 | B2 | 4/2004 | Sines et al. |
| 6,758,751 | B2 | 7/2004 | Soltys et al. |
| 6,889,979 | B2 | 5/2005 | Blaha |
| 7,556,266 | B2 | 7/2009 | Blaha et al. |
| 7,967,294 | B2 | 6/2011 | Blaha et al. |
| 2002/0163125 | A1 | 11/2002 | Grauzer et al. |

FOREIGN PATENT DOCUMENTS

| | | |
|---|---|---|
| JP | 2000-251031 A | 9/2000 |
| JP | 2003-250950 A | 9/2003 |
| WO | 99/52611 | 10/1999 |

* cited by examiner

CARD SHUFFLER WITH GRAVITY FEED SYSTEM FOR PLAYING CARDS

CROSS-REFERENCE TO RELATED APPLICATIONS

This application is a continuation of U.S. patent application Ser. No. 13/540,434 filed Jul. 2, 2012, now U.S. Pat. No. 8,544,848, issued Oct. 1, 2013, which is a continuation of U.S. patent application Ser. No. 13/171,360, filed Jun. 28, 2011, now U.S. Pat. No. 8,210,536 issued Jul. 3, 2012, which is a continuation of U.S. patent application Ser. No. 12/498,297, filed Jul. 6, 2009, now U.S. Pat. No. 7,967,294, issued Jun. 28, 2011, which, in turn, is a continuation of U.S. patent application Ser. No. 11/389,524, filed Mar. 24, 2006, now U.S. Pat. No. 7,556,266, issued Jul. 7, 2009. The disclosure of each of the foregoing documents is hereby incorporated herein by reference in its entirety.

TECHNICAL FIELD

The present invention relates to the field of playing card shufflers and particularly to the use of a gravity feed system for assisting entry of the cards into a transportation system or card moving system of a playing card shuffling system.

BACKGROUND

In the gaming industry, certain games require that batches of randomly shuffled cards be provided to players and sometimes to dealers in live card games. It is important that the cards are shuffled thoroughly and randomly to prevent players from having an advantage by knowing the position of specific cards or groups of cards in the final mass of cards delivered in the play of the game. At the same time, it is advantageous to have the deck(s) shuffled in a very short period of time so that there is minimal down time in the play of the game.

U.S. Pat. No. 5,944,310 describes a card handling apparatus comprising: a loading station for receiving cards to be shuffled; a chamber to receive a main stack of cards; delivery means for delivering individual cards from the loading station to the chamber; a dispensing station to dispense individual cards for a card game; transfer means for transferring a lowermost card from the main stack to the dispensing station; and a dispensing sensor for sensing one of the presence and absence of a card in the dispensing station. The dispensing sensor is coupled to the transfer means to cause a transfer of a card to the dispensing station when an absence of a card in the dispensing station is sensed by the dispensing sensor. Individual cards delivered from the loading station are randomly inserted by insertion means into different, randomly selected positions in the main stack to obtain a randomly shuffled main stack from which cards are individually dispensed. The insertion means includes vertically adjustable gripping means to separate the main stack into two spaced substacks to enable insertion of a card between the substacks by the insertion means. The gripping means is positionable vertically along the edges of the main stack. After gripping, the top portion of the stack is lifted, forming two sub-stacks. At this time, a gap is created between the stacks.

Similarly, U.S. Pat. No. 5,683,085 describes apparatus for shuffling or handling cards including a chamber in which a main stack of cards are supported, a loading station for holding a secondary stack of cards, and a card separating mechanism for separating cards at a series of positions along the main stack to allow the introduction of cards from the secondary stack into the main stack at those positions. The separating mechanism grips cards at the series of positions along the stack and lifts those cards at and above the separation mechanism to define spaces in the main stack for introduction of cards from the secondary stack.

U.S. Pat. No. 5,676,372 describes an automated playing card shuffler, comprising: a frame; an unshuffled stack holder for holding an unshuffled stack of playing cards; a shuffled stack receiver for holding a shuffled stack of playing cards; at least one ejector carriage mounted adjacent to the unshuffled stack holder, the at least one ejector carriage and the unshuffled stack holder mounted to provide relative movement between the unshuffled stack holder and the at least one ejector carriage; a plurality of ejectors mounted upon the at least one ejector carriage adjacent the unshuffled stack holder, for ejecting playing cards from the unshuffled stack, the ejecting occurring at various random positions along the unshuffled stack.

U.S. Pat. Nos. 6,139,014 and 6,068,258 describe a machine for shuffling multiple decks of playing cards in a batch process. The device includes a first vertically extending magazine for holding a stack of unshuffled playing cards, and second and third vertically extending magazines each for holding a stack of cards, the second and third magazines being horizontally spaced from and adjacent to the first magazine. A first card mover is positioned at the top of the first magazine for moving cards from the top of the stack of cards in the first magazine to the second and third magazines to cut the stack of unshuffled playing cards into two unshuffled stacks. Second and third card movers are at the top of the second and third magazines, respectively, for randomly moving cards from the top of the stack of cards in the second and third magazines, respectively, back to the first magazine, thereby interleaving the cards to form a vertically registered stack of shuffled cards in the first magazine. Elevators are provided in the magazines to bring the cards into contact with the card movers.

U.S. Pat. No. 6,019,368 describes a playing card shuffler having an unshuffled stack holder that holds an infeed array of playing cards. One or more ejectors are mounted adjacent the unshuffled stack holder to eject cards from the infeed array at various random positions. Multiple ejectors are preferably mounted on a movable carriage. Extractors are advantageously used to assist in removing playing cards from the infeed array. Removal resistors are used to provide counteracting forces resisting displacement of cards, to thereby provide more selective ejection of cards from the infeed array. The automated playing card shuffler comprises a frame; an unshuffled stack holder for holding an unshuffled array of playing cards in a stacked configuration with adjacent cards in physical contact with each other and forming an unshuffled stack; a shuffled array receiver for holding a shuffled array of playing cards; at least one ejector for ejecting playing cards located at different positions within the unshuffled stack; and a drive which is controllable to achieve a plurality of different relative positions between the unshuffled stack holder and the at least one ejector.

U.S. Pat. No. 6,149,154 describes an apparatus for moving playing cards from a first group of cards into plural groups, each plural group containing a random arrangement of cards, the apparatus comprising: a card receiver for receiving the first group of unshuffled cards; a single stack of card-receiving compartments generally adjacent to the card receiver, the stack generally adjacent to and movable with respect to the first group of cards; and a drive mechanism that moves the stack by means of translation relative to the first group of unshuffled cards; a card-moving mechanism between the card receiver and the stack; and a processing unit that controls the card-moving mechanism and the drive mechanism so that a selected quantity of cards is moved into a selected number of compartments.

U.S. Pat. No. 6,254,096 describes an apparatus for continuously shuffling playing cards, the apparatus comprising: a card receiver for receiving a first group of cards; a single stack of card-receiving compartments generally adjacent to the card receiver, the stack being generally vertically movable, wherein the compartments translate substantially vertically, and means for moving the stack; a card-moving mechanism between the card receiver and the stack; a processing unit that controls the card-moving mechanism and the means for moving the stack so that cards placed in the card receiver are moved into selected compartments; a second card receiver for receiving cards from the compartments; and a second card-moving mechanism between the compartments and the second card receiver for moving cards from the compartments to the second card receiver.

U.S. Pat. No. 6,267,248 describes an apparatus for arranging playing cards in a desired order, the apparatus including: a housing; a sensor to sense playing cards prior to arranging; a feeder for feeding the playing cards sequentially past the sensor; a storage assembly having a plurality of storage locations in which playing cards may be arranged in groups in a desired order, wherein the storage assembly is adapted for movement in at least two directions during shuffling; a selectively programmable computer coupled to the sensor and to the storage assembly to assemble in the storage assembly groups of playing cards in a desired order; a delivery mechanism for selectively delivering playing cards located in selected storage locations of the storage assembly; and a collector for collecting arranged groups of playing cards.

U.S. Pat. No. 4,586,712 describes a card shuffling apparatus that comprises an input apparatus, an output storage means and an interposed shuffling storage means. The cards are inserted via a narrow gap into the shuffling storage means. Sensors (photoelectric cells) check whether the respective compartments of the shuffling storage means are free for receiving cards, with the status of each compartment being stored in an electronic register.

EP 0 777 514 B1 describes a card shuffling apparatus that conveys the cards from an input apparatus to a shuffling storage means and from there to the output storage means. The introduction into the shuffling storage means occurs via guide elements that press the currently drawn card against draw-in rollers. Sensors detect whether cards are conveyed out of the input apparatus into the shuffling container and from there out again in order to enable the control of the respective motors for driving the draw-in rollers and the shuffling storage means.

U.S. Pat. No. 6,889,979 suggests that the teachings in the art of playing card shufflers relates to technical solutions for shuffling playing cards and that little emphasis is placed on a continual verification of the number of used playing cards situated in the card shuffler. That Patent asserts that this disadvantage is avoided by providing a card shuffler that is capable of continuously displaying the number of playing cards situated in the card shuffler or in the shuffling storage means and, thus, giving the operator the opportunity to have certainty at all times about the complete number of playing cards. The described shuffling system offers an error-free possibility of detecting the number of the cards situated in the shuffling storage means, thus reducing the possibility of unauthorized and unnoticed removal of cards from a game. The introduction of a card into the shuffling storage means and the removal of the cards from the shuffling storage means can be detected in a contact free manner.

There are essentially four or five types of automatic playing card shuffler formats known in the art, and those formats include 1) a riffling or interleaving action in which cards are separated into approximately two stacks of cards and shuffled together (riffled) to combine the two sets into a single set, 2) a system wherein two stacks of cards are provided with a central stack of cards, and cards are randomly moved from the top of the two stacks into a central stack (and some of the cards from the central stack may also be moved randomly back into the two stacks) until a final single stack of cards is formed, 3) a single set of cards is moved one card at a time randomly into compartments (carousels, fans, wheel, stacks, etc.) and the cards in the compartments are delivered to a final card collection area, and 4) a set of cards has cards randomly ejected from within the set and transported to a collection area (or compartments and then a collection area). These shuffler systems are taught in the above cited references, all of which are herein incorporated in their entireties by reference.

In feeding a single deck or a single set of cards into shufflers where a single deck or single set of cards is initially provided, and cards are removed from the single deck or single set, one at a time from the single set to another function in the shuffler, a number of problems tend to arise. Among the more common problems are the ability to consistently feed a single card (rather than multiple cards) from the single set into the shuffler, the ability to assure that the last of the playing cards in the first set placed into the input area are moved out of the system, and preventing premature activation of the removal of cards by the shuffler as the first set of playing cards are inserted into the input area.

SUMMARY OF THE INVENTION

A gravity feed system is provided for assisting playing card shuffling devices in moving an initial set of cards first placed into the shuffling device and then moved into a card handling region of the shuffler. The system is referred to as a gravity feed because it is primarily gravity that motivates or moves the cards toward mechanical elements that further move and direct playing cards within the shuffler, such as pick-off rollers. The gravity feed system has a critical and narrow angle of slope on which the cards are seated and may be provided with extendable/retractable barriers to prevent premature movement of the first set of cards by mechanical elements that move playing cards out of the card input area toward the shuffling system.

BRIEF DESCRIPTION OF THE FIGURES

The invention is now explained in closer detail by reference to the enclosed drawings, wherein.

DETAILED DESCRIPTION OF THE INVENTION

Figure 1:
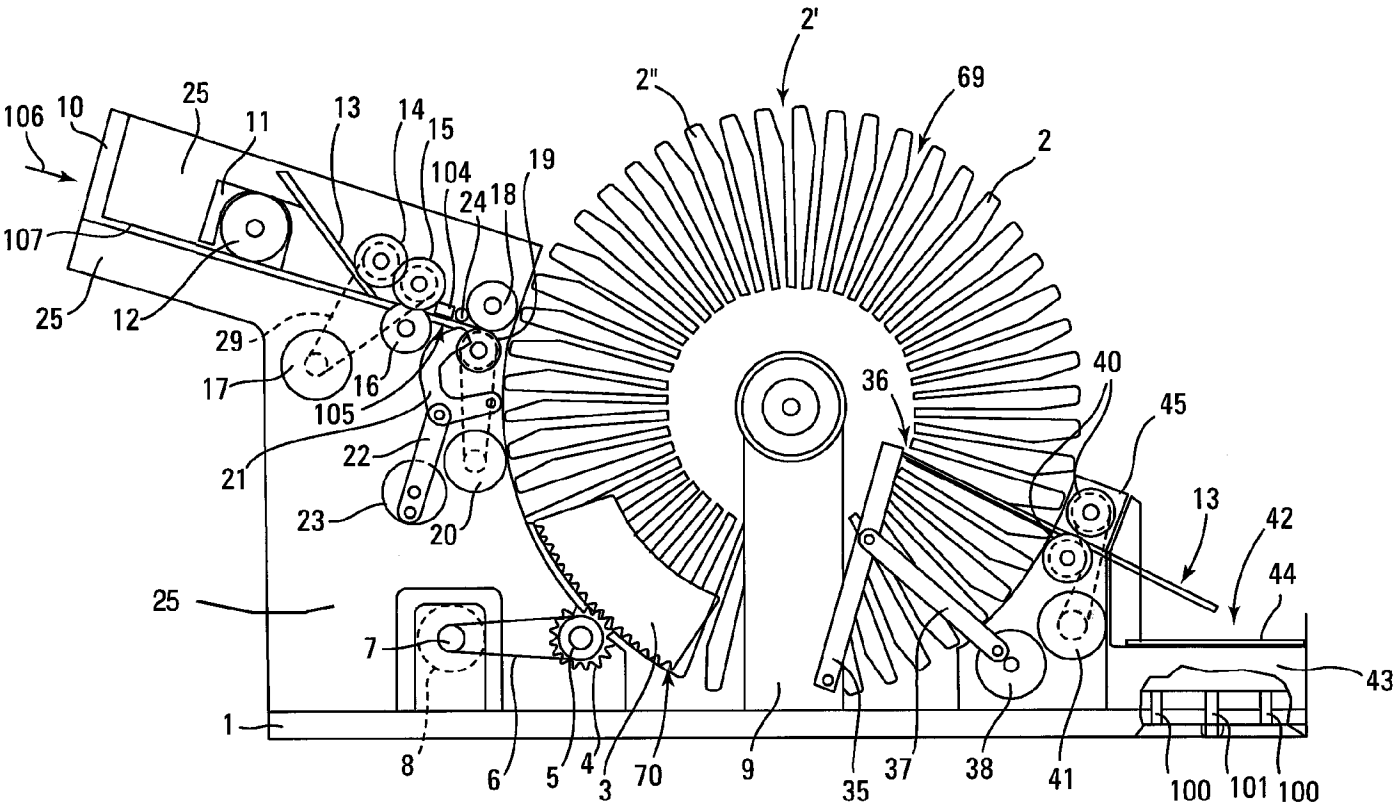
FIG. 1 schematically shows a card shuffler in accordance with the invention with cover removed.

The description of the practice of the present technology will be generally described with regard to one particular format of playing card shuffling device as previously described in U.S. Pat. No. 6,889,979, which has been incorporated by reference herein. Even though the descriptions and examples focus on that particular construction, as noted above, the technology originally described herein is useful in any playing card shuffling device where cards are to be moved from one stack of cards into a card moving system. In FIG. 1, a carousel format shuffling storage means 2' is situated on a console formed of two legs 9 (only one leg 9 is visible because of the side view), which are arranged on a base plate 1, which shuffling means is formed by a rotatably held drum 2. The drum, carousel or wheel 2 is shown connected via spacers 62 (FIG. 6) with two disks 3. However, the drum may be a unified, single piece molded article. The flanges 2" of the drum 2 are provided with or form compartment-like slots 69, which are provided for receiving one or more cards 13.

The disks 3 are each shown in FIG. 1. Each disk 3 is provided with a circular toothing 70 that serves as a pinion gear. The shuffling storage means 2' can be driven via a gear 4 mounted to shaft 5 or any other driving mechanism, (such as pulleys, magnetic gearing and the like). The gear 4 is, in turn, belt driven via a continuous belt 6, by a rotational shaft 7 driven by motor 8, as shown by dashed lines. Gear 4 and motor 8 are jointly held rotatably inside a housing, one side of which is shown as a plate or bar 25. The motor 8 may be driven via a random-check generator and optionally moves the shuffling storage means 2' in mutually opposite directions (e.g., clockwise and counterclockwise), so that an oscillating movement of the shuffling storage means 2' can occur and a shortest route to a next selected compartment 69 for insertion of cards 13 can be achieved. Although specific structures, features and components are discussed as previously noted, these are merely specific examples within a disclosure of a generic concept.

Figure 2:
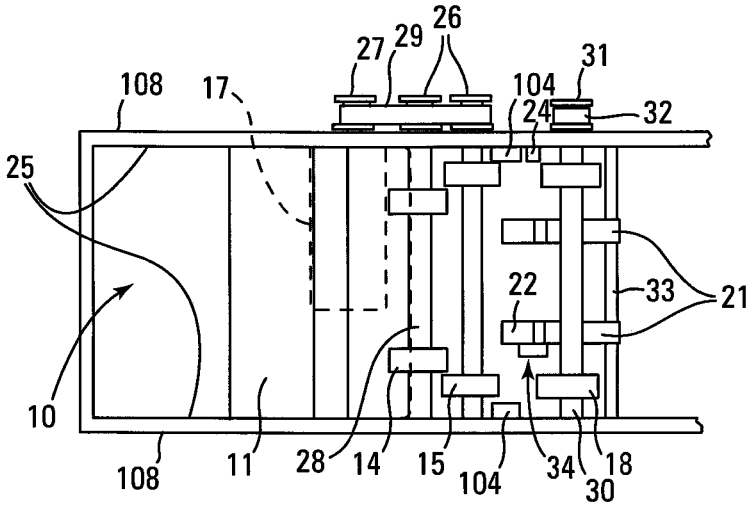
Fig. 2 Prior Art
FIG. 2 shows a top view of an input apparatus.

A prior art system for input of cards (according to the teachings of U.S. Pat. No. 6,889,979) is shown with its playing card storage container or playing card input compartment 10 for the playing cards to be randomized, shuffled or sorted (e.g., played cards) 13. This card input compartment 10 is provided as part of a playing card input apparatus 106. The card input compartment 10 comprises a wedge 11 that rolls by way of a roller 12, which is arranged rotatably in the same on an inclined floor 107 of the playing card storage container 10 against two elastic rollers 14 (FIG. 2). The two rollers 14 (again, only a single roller can be seen because of the side view) are held rotatably on a common shaft 28 between the two plate bars 25 that form sides of the housing and the rollers 14 can be driven jointly with the rollers 15 via two pulleys 26 (FIG. 2), a toothed belt 29 (FIG. 2) as well as a pulley 27 (FIG. 2) via a motor 17. Two rollers 16 touch the two rollers 15 at their circumferences, so that they are co-rotated by surface friction.

In FIG. 2 and with continued reference to FIG. 1, two bridges 104 each form with the floor 107 of the playing card input compartment 10 a gap-like draw-in zone 105, which is substantially the thickness (yet still greater than the actual thickness) of a playing card 13 to guarantee that only one card at a time is conveyed to the shuffling storage means 2' and to prevent jamming or misalignment of cards within the input compartment 10. A positional or optical reading (camera) sensor 24 may be provided, preferably as an optical sensor for recognizing the presence or rank/suit of respectively moved cards 13. Each card 13 that is moved from the playing card storage container 10 to the shuffling storage means 2' must therefore first pass a gap-like draw-in zone 105, and then pass the sensor 24, one after the other, with the sensor 24 being covered or triggered at first by the playing card 13 entering the sensor zone and being uncovered again after the passage of the card 13. An electronic controller, preferably a microprocessor, which is provided downstream of the sensor 24, may therefore register the change from a covered to uncovered sensor 24 as a passing playing card 13, as long as the electronic control does not recognize a jam in the card path.

The electronic control advances the cards 13 so that they are inserted one by one into the individual compartments 69 of the shuffling storage means 2' and stores the information in an electronic register and then the electronic control subtracts the cards 13 taken from individual compartments 69 according to their number from the electronic register with the goal of keeping a continual inventory on the playing cards 13 situated in the shuffling storage means 2'.

A jam in the card path is recognized when the rollers 14, 15 or 19 are stopped and thus the motors 17 and 20 show an increased current consumption. Alternatively, a jam can be recognized when the playing card 13 covers the sensor 24 for a longer period than that time which corresponds to the conveying speed of rollers 14 and 15 with respect to the conveyance of a playing card 13 or when the sensor 24 remains uncovered for a longer period than is standard for an active shuffling mode for the device while the electronic control triggers the drive of the rollers 14 and 15 and the playing cards 13 are located in the storage container 10. This jamming event or fact can also be verified through a sensor (not shown) in floor 107.

The roller pair 19 and roller pair 18, which touches the other pair on their circumferences, and which pair of rollers 18 are each situated on a shaft 30 can be driven in the same manner by motor 20 as described above.

Two levers 21 are shown in FIG. 2 as being used for fully pushing the respectively moved card 13 into a compartment 69 (FIG. 1) of the shuffling storage means 2' and can be driven in an oscillating fashion via the rod 22, which is swivelably connected with one of the levers 21 by the shaft 34, through an eccentric disk 23 seated on a motor. Any other injection means, including gravity and momentum from rollers (e.g., roller pairs 18 and 19) may also be used to advance cards 13 into compartments 69.

At least two variants of an output storage means 42, 42' are provided for the shuffled cards 13, which output storage means can be fastened optionally on the base plate 1 and can be exchanged easily for each other.

Figure 4:
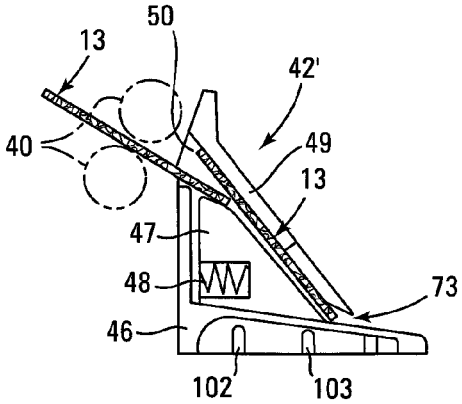
FIG. 4 shows an output storage means in which shuffled cards are output.

A card storage means or card receiving means 42 comprising a support area, such as a U-shaped table 43 is provided that comprises two alignment pins 100 which are inserted into the base plate 1 and on which the card storage means 42 (FIG. 1), card storage means 42' (FIG. 4) for the shuffled cards can be inserted onto the end of the shuffling storage means 2', which card storage means is provided in the zone of its floor with respective bores 102 (FIG. 4). To fix or secure the respective card storage means 42, 42' a screw 101 may be provided, which engages in a threaded bore 103 of the card storage means 42, 42'.

Figure 3:
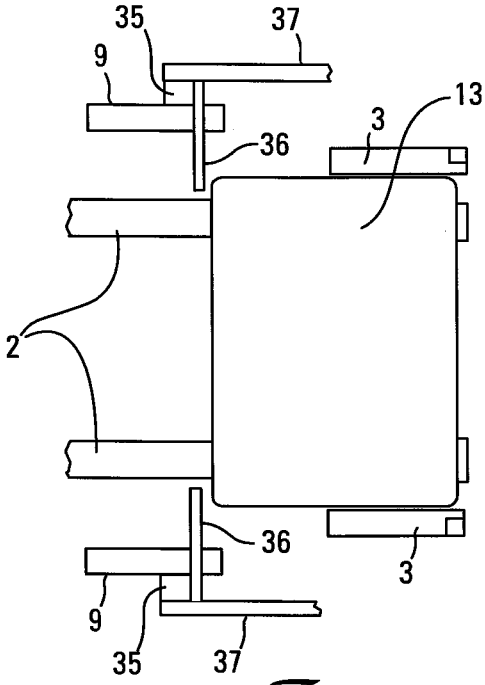
FIG. 3 shows a detail of a withdrawing apparatus.

The output of the cards 13 from the compartments 69 to a card storage means 42, 42' may be effected or occurs by means of a pushing or ejection device, such as two swiveling arms 35 which are swivelably mounted on the two legs 9 and are oscillatingly drivable via lever 37 and via an eccentric disk 38 seated on a motor. Pins, bars, shafts, plates, compressed air, rollers and other physical systems may also be used to remove cards from the slots 69. The two swiveling arms 35 shown each carry at their upper end an inwardly projecting rail 36 (FIG. 3) which grasps the cards 13 situated in a compartment 69 and conveys them to a nip line of two clamping rollers 40. The clamping rollers 40 are held in the sides of the housing or plate bars 45 and are simultaneously drivable by a motor 41.

The clamping or transporting nip rollers 40 convey the respectively moved cards 13 to the card storage means 42 as shown in FIG. 1 for the shuffled or sorted cards for the purpose of a stack-wise removal of the cards 13, or to a card storage means 42' for a removal of shuffled cards 13 one after the other.

A card storage means 42 is shown as formed substantially by a U-shaped table 43 in which the cards 13 are deposited in a stack 44. The cards can be upwardly removed from the U-shaped table 43 by the croupier in an optionally stack-wise manner.

Figure 4A:
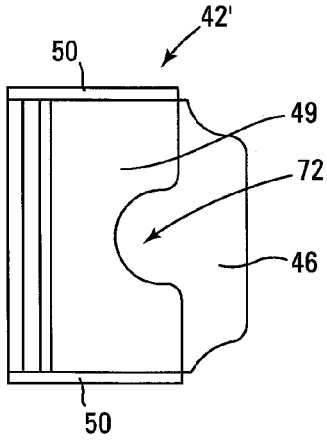
FIG. 4A shows a top view of the output storage means according to FIG. 4.

The card storage means 42' according to FIGS. 4 and 4A is provided for removing cards 13 one by one. The cards 13 emerging from the nip line of the clamping rollers 40 enter the card storage means 42' via a gap 50, which card storage means 42' is delimited by a downwardly extending oblique wall 49 and, for example, a spring-loaded block 47. The cards 13, which may also optionally be present within the shuffling storage means 2', several of them at the same time, are pushed between the block 47 and the wall 49 or the cards 13 already situated in the card storage means 42', with the block 47 being pushed back against the force of the spring 48. The block 47 slides over the inclined plane of an L-shaped basic body 46. A gap 73 remains between the lower edge of the wall 49 and the L-shaped basic body 46 through which the cards 13 can be withdrawn one by one.

As is shown in FIG. 4A, the inclined wall 49 is provided at its lower edge with a centrally arranged recess or opening 72 that facilitates the withdrawal of individual cards 13. The card storage means 42' is delimited at the side by walls 50. The shuffled cards 13 can be removed one by one by the croupier in such a way that the front one of the playing cards 13 is grasped by friction with the fingers through the recess 72 in wall 49 and a single card is pulled out through the gap 73.

Figure 5:
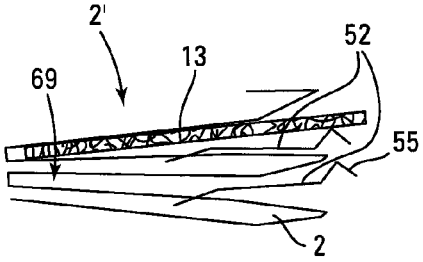
FIGS. 5 and 5A show details of variants in an arrangement of compartments of shuffling storage means.
Figure 5A:
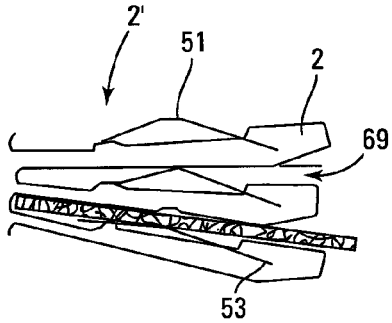

As is shown in FIGS. 5 and 5A, springs 51, 52 are arranged in the compartments 69 of the shuffling storage means 2', which produce a clamping of the card(s) 13 pushed into each respective compartment 69. A spring 52 is provided with a bend-off 55 that covers radially outer openings of the compartments 69 and prevents cards 13 from being ejected outwardly through centrifugal force during the rotation of the shuffling storage means 2'.

The springs 51, according to FIG. 5A, are arranged as bent or offset leaf springs and are inserted in a slot 53 of the one wall of the compartment 69 and press against the respective opposite wall of the compartment 69. The card 13 pushed into the respective compartment 69 is therefore clamped between spring 51 and the opposite wall of the compartment 69 and held in this way in the respective compartment 69.

The output of the cards 13 of a compartment 69 occurs in such a way that the card 13 or a package of up to nine cards 13, for example, is ejected as a group. This occurs by means of the swiveling arms 35 and the rails 36, as has already been described above with regard to FIG. 3. The springs 51, 52 are deformed during the ejection of the card(s) 13.

Figure 6:
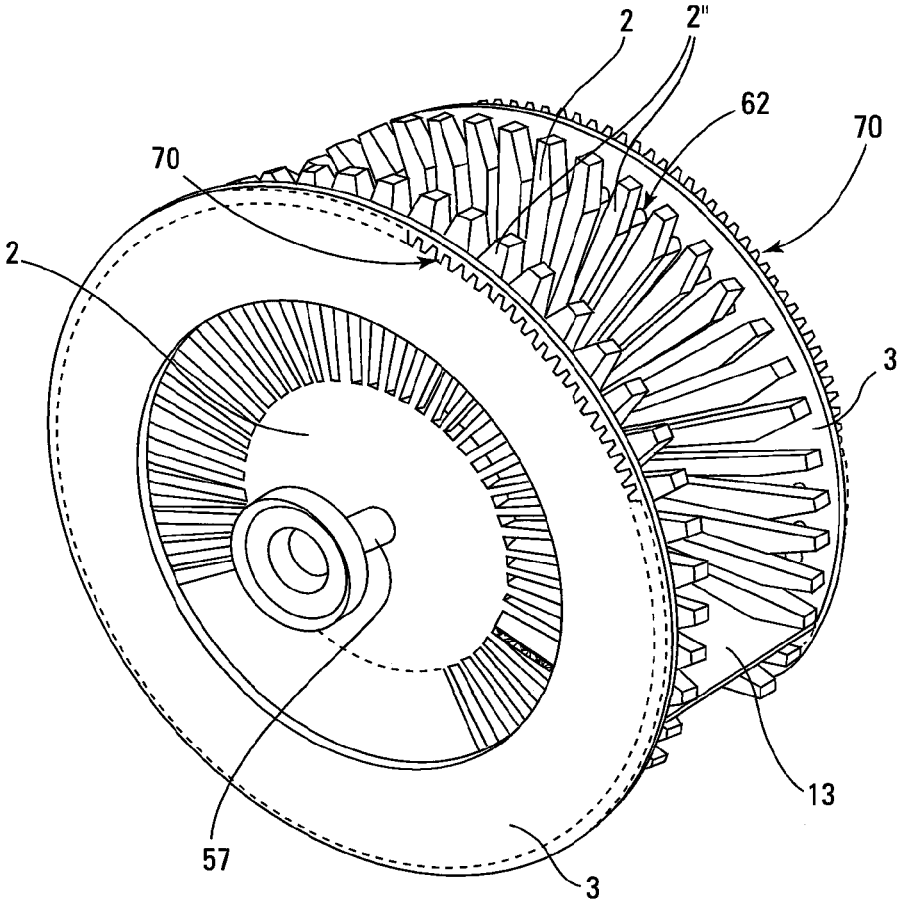
FIG. 6 shows a perspective view of a shuffling storage means.

As is shown in FIGS. 1 and 6, the drum 2 rests with its axle journals 57 in receiving means of the legs 9 and can be removed or lifted off from the same easily. Since the compartments 69 are provided with springs 51, 52, the cards 13 remain in their compartments 69 when the drum 2 is removed.

Figure 7:
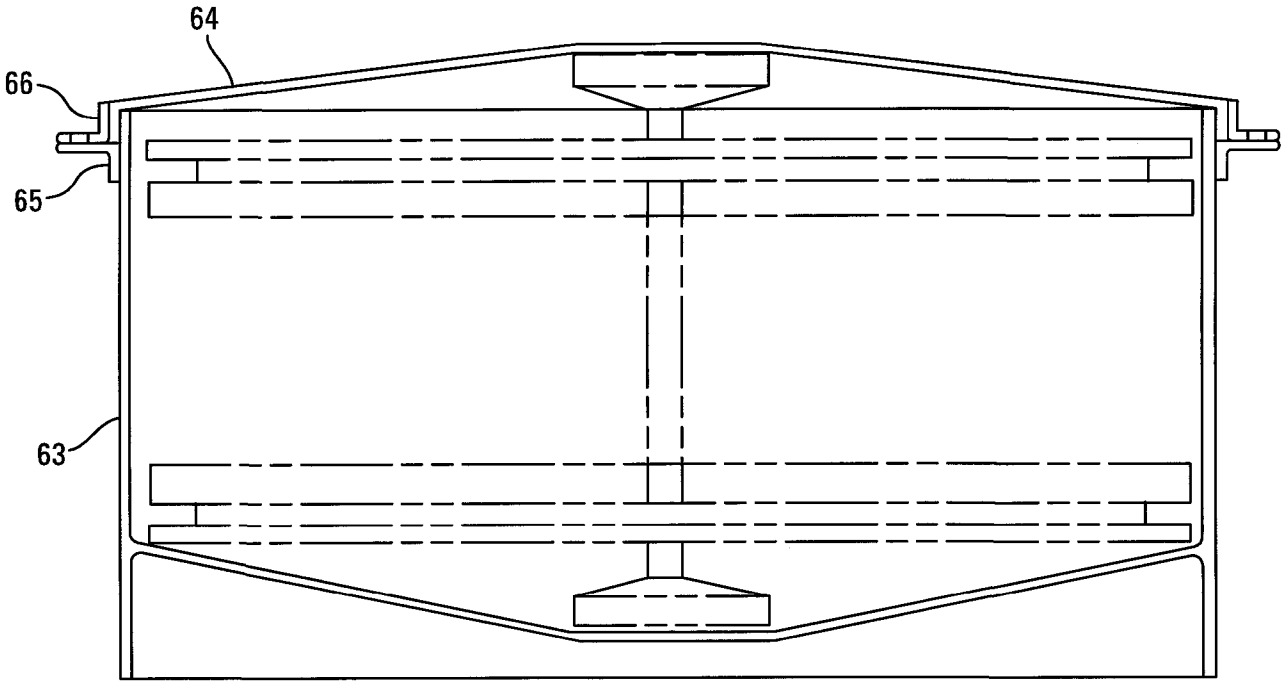
FIG. 7 shows a top plan view of a security container with a shuffling storage means.

The drum 2 can be placed in a security container 63 (FIG. 7) and can be transported with the same, with the container 63 being closeable by a lid 64. For this purpose, flanges 65, 66 are fastened to the container 63 and the lid 64. This allows connecting and locking the container 63 with the lid 64 in a manipulation-proof way.

In order to continually check the number of cards 13 situated in the shuffling storage means 2', it is necessary to detect the number of all cards 13 that were placed in the compartments 69 of the shuffling storage means 2'. At the same time, it is necessary to detect the number of cards 13 that were removed from the compartments 69. For this purpose it must be ensured at first that the cards 13 are inserted into the compartments 69 one by one. It is provided for this purpose in accordance with one embodiment of the invention that the cards 13 are guided through a gap-like draw-in zone 105 (see FIG. 1) of defined thickness, with the thickness corresponding substantially to the thickness of a card 13. The gap-like draw-in zone 105 is defined in the present embodiment by two bridges 104 that project inwardly from the side walls 108 of the storage container 10 and are separated from the floor 107 of the storage container 10 a distance substantially equal to the thickness of a card 13. It is understood that instead of the two bridges 104, it is also possible to provide a continuous bridge, which connects the two side walls 108 of the storage container 10.

After the card 13 has passed draw-in zone 105 (again, see FIG. 1), a sensor 24, preferably an optical sensor, is provided that detects the passage of a card 13. After the passage of a card 13, an internal register of an electronic memory of the electronic control is increased by the value of one. At the same time, the electronic control system stores the number of the compartment 69 in which the card 13 was inserted. The allocation of numbers to individual compartments 69 also occurs by the electronic control system upon activating the card shuffler.

When cards 13 are removed from the compartments 69 of the shuffling storage means 2', this occurs via the withdrawing apparatus, including swiveling arms 35, lever 37, and eccentric disk 38, as described above. In the present embodiment, a compartment 69 can only be emptied completely. Since the electronic control system is informed at all times about the number of cards 13 per compartment (card value) it is thus easy to determine how many cards are taken from the shuffling storage means 2'.

A sensor detects actuation of the withdrawing apparatus, including swiveling arms 35, lever 37 that ejects all cards from a compartment as a group. An internal sensor facing the front side of playing cards (not shown) may be positioned within the device where cards are stationary or where cards are moving to read the rank and suit of cards so that such rank and/or suit information may be passed to a processor that can use that information for various legitimate purposes within the venue of a casino.

The sum total of the cards 13 situated in the shuffling storage means 2' is thus obtained in a simple manner by the addition of the cards 13 inserted in the shuffling storage means 2' and the subtraction of the cards 13 removed therefrom.

It is understood that the method can also be applied to a card shuffler, which allows the removal of individual cards 13 from the shuffling storage means 2', i.e., an entire compartment 69 is therefore not completely emptied. In this case it is not necessary that the electronic control system stores the number of cards 13 per compartment 69, because after the removal of the individual cards 13 from the shuffling storage means 2' the same can be moved past a sensor again. As a result, the electronic control system is informed at all times about the cards 13 individually supplied to and removed from the shuffling storage means 2', as a result of which the sum total of the cards 13 situated in the shuffling storage means 2' is always known.

Improved Gravity Feed System

Figure 8:
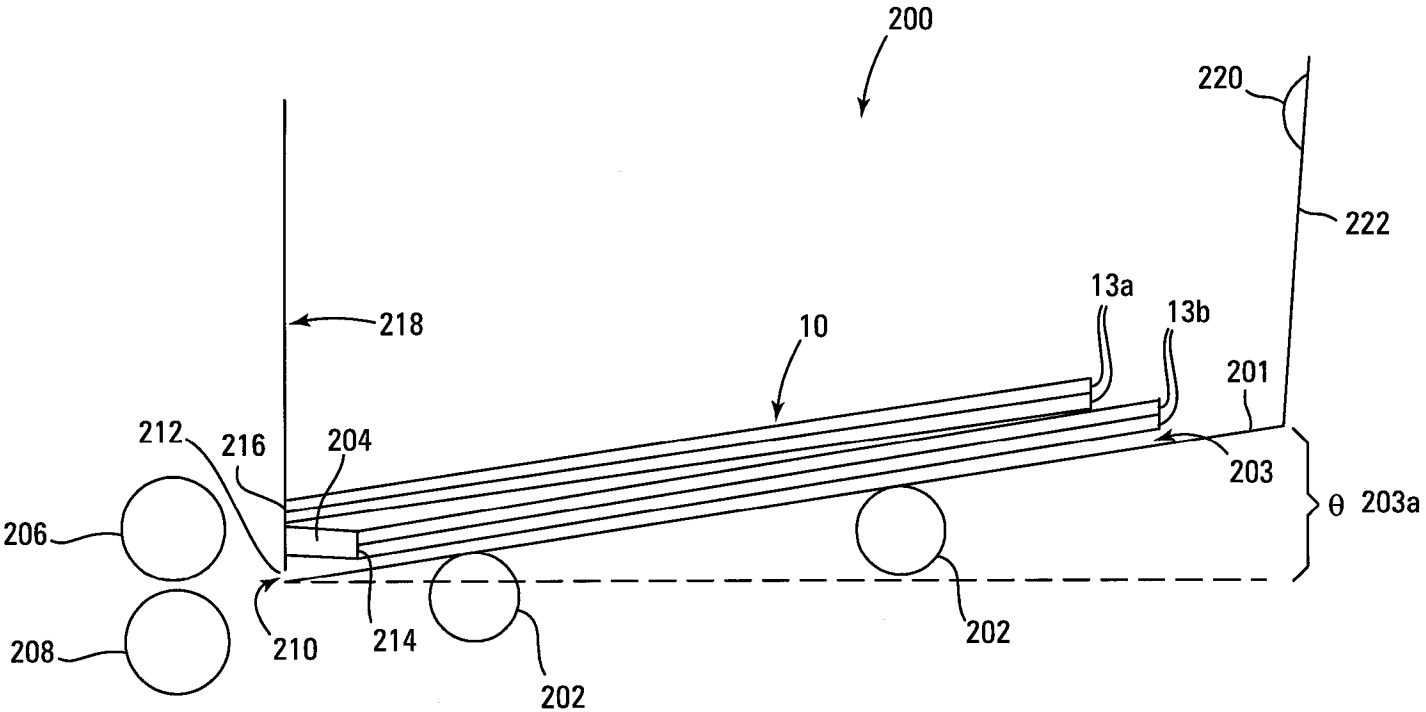
FIG. 8 shows a side elevational view of a gravity feed section of a shuffler.

FIG. 8 shows a side view of a novel gravity feed section 200 of a shuffler playing card input compartment 10. A base plate 201 for the playing card input compartment 10 is shown, with two pick-off rollers 202 shown extending through the base plate 201 to contact the upper cards 13*a* and lower cards 13*b* of playing cards in the playing card input compartment 10. A slight separation 203 is shown for illustrative purposes between the bottommost cards of lower cards 13*b* and the support plate 201. There is a critical angle θ 203*a* that exists with respect the support plate 201 and the horizon. That angle must be steep enough for the effects of gravity to significantly balance or overcome static friction between the playing cards and the support plate 201 and gradual enough so that cards are not forced too strongly down an incline over the support plate 201. Even though the frictional forces could be controlled by modifying the surface properties of the support plate 201, the angle has been found to be more important, as the surface of the support plate 201 will change over time with usage. That critical angle has been found to be circumscribed around 17°, as between 12°-21°, preferably between 13°-20°, and more preferably a slope between 15°-19°. As shown in FIG. 8, the ends 214 of lower cards 13*b* are stopped by extending and recessing pins (which may be provided as "fingers" passing through or under the wall 218) or plate 204 while the ends 216 of upper cards 13*a* pass over the pins or plate 204 to rest against the wall 218 of the card input compartment 10. The pin or plate 204 prevents lower cards (such as 13*b*) from continuing downward into the exit slot or screening slot 210 where they would then contact advancing nip rollers 206, 208. The number of cards passing through slot 210 is at least partially controlled by the size of slot 210 which is determined by the gap between the lower plate 210 and the lowest point 212 of end wall 218. Also shown is a nub or glide element 220 that is affixed to the inside of the back wall 222 of the playing card input compartment 10. The glide element 220 assists in allowing cards to slide down into the card input compartment 10 and giving cards a slight push forward, down the slope, in the card input compartment 10. The guide element 220 may be constructed of a hard material such as metal or hard plastic or a softer material such as rubber or a softer plastic.

Figure 8A:
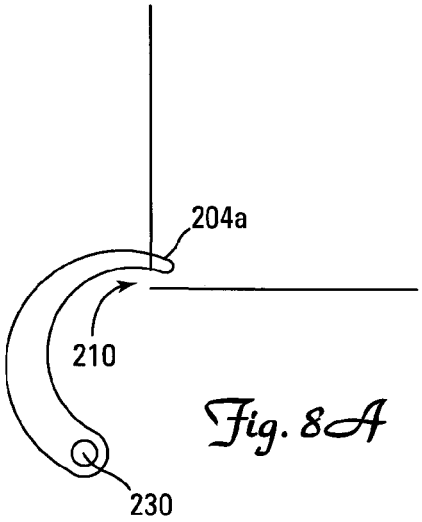
FIGS. 8A through 8D show variations of blocking elements to prevent playing cards from prematurely exiting a playing card input compartment.

FIGS. 8A through 8D show variations on blocking elements for a gravity feed system or for any other slot feed system. FIG. 8A shows a "finger" blocking element 204*a* in a blocking position. The end of the finger blocking element 204*a* extends far enough to block the slot 210, preventing any playing cards (not shown) from entering the slot 210. The blocking element 204*a* may unblock by rotating about pin or pivot point 230.

Figure 8B:
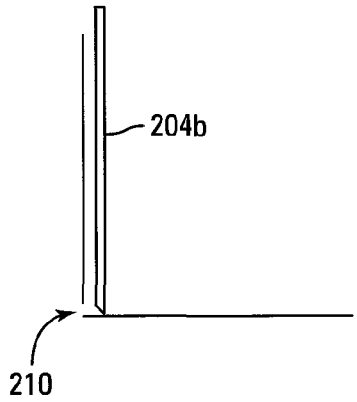

FIG. 8B shows a blocking plate or panel 204*b* that can be moved vertically to block the slot 210.

Figure 8C:
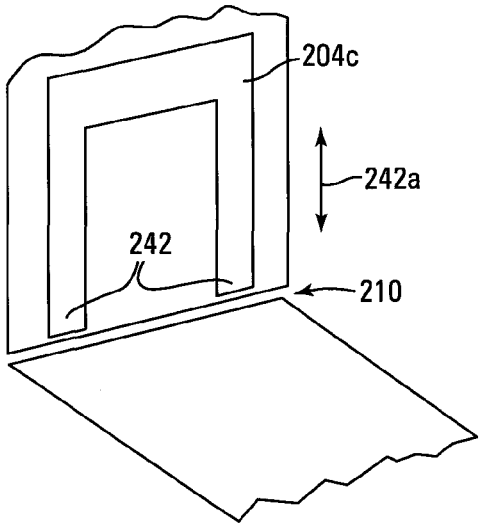

FIG. 8C shows a vertically transposing blocking element 204*c* that has two arms 242 that move down and up (see arrow 242*a*) to block and unblock, respectively, the slot 210.

Figure 8D:
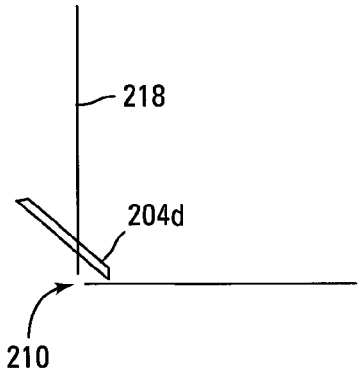

FIG. 8D shows an angled pin or plate 204*d* that moves at an angle through the wall 218 to extend downward to block the slot 210, and would be retracted upwardly to clear the slot 210.

Figure 9:
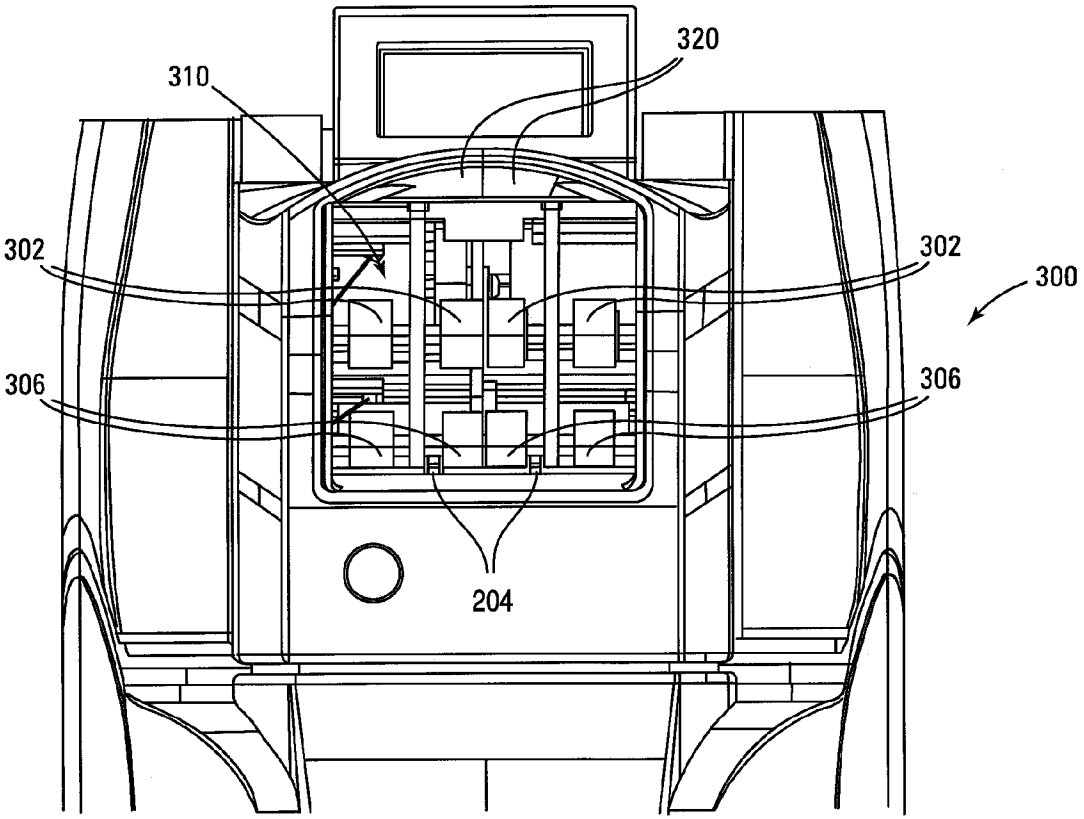
FIG. 9 shows a top view of a gravity feed section with a playing card support plate removed.

FIG. 9 shows a top view of the gravity feed section 300 of a shuffler with the playing card support plate removed to expose the pick-off rollers 302 and 306. The pins 204 can be seen extending into the card receiving well 310. The pins 204 do not have to be very large to prevent playing cards from advancing against the slot (not shown) and may be flat, rounded, sloped or even form a continuous bar or plate a sufficient portion of or across the slot so as to prevent card entry. Although the pins 204 are shown here as extending approximately horizontally or at a slight downward slope (see FIG. 8) to block the slot, a plate, pins, a bar, or other blocking surface may move in a more vertical direction to block the slot and then retract to expose the slot. A slope or guide 320 on the rearward side of the system is present to assist in guiding playing cards into the gravity feed section 300.

Figure 10:
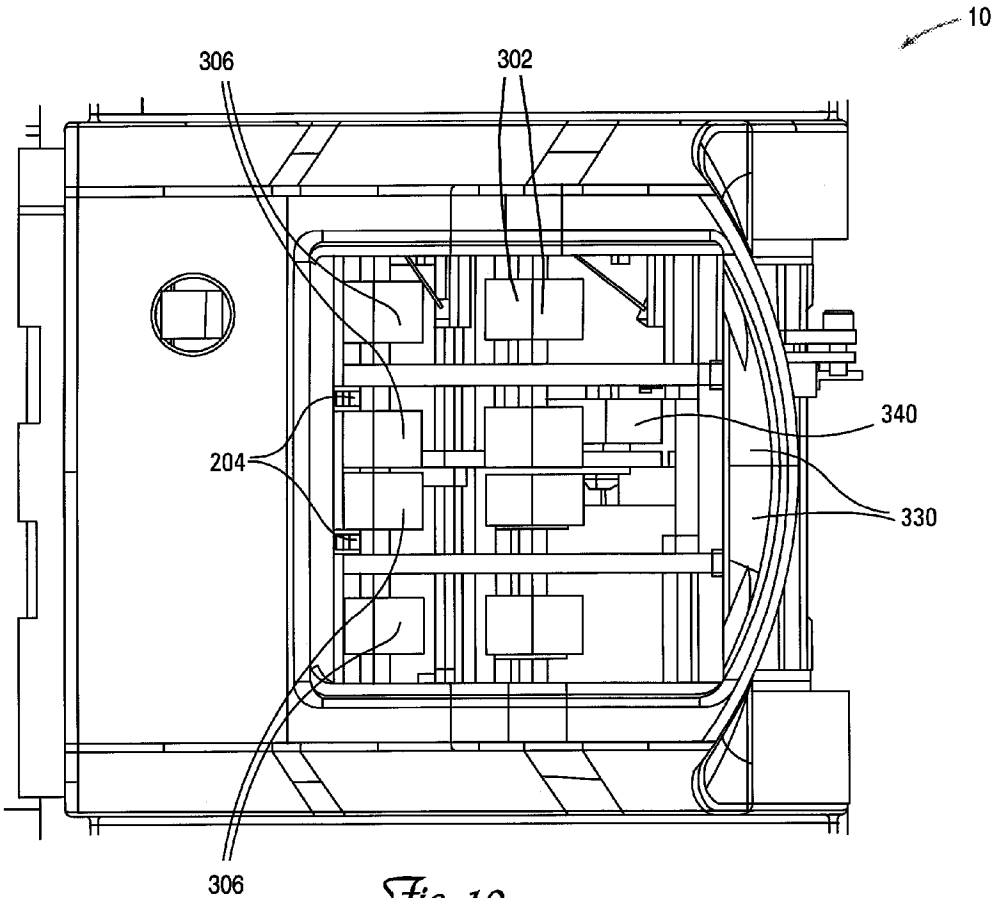
FIG. 10 shows a top view of a playing card input compartment with a support plate removed, the pick-off and transportation rollers exposed, and part of a lever for a blocking element shown.

FIG. 10 is a top view of the playing card input compartment 10 with a support plate removed, the pick-off roller 340 and transportation rollers 302, 306 exposed, and part of the levers 204 for a blocking element shown. A slide 330 for directing cards into the input area 10 is also shown.

Figure 11:
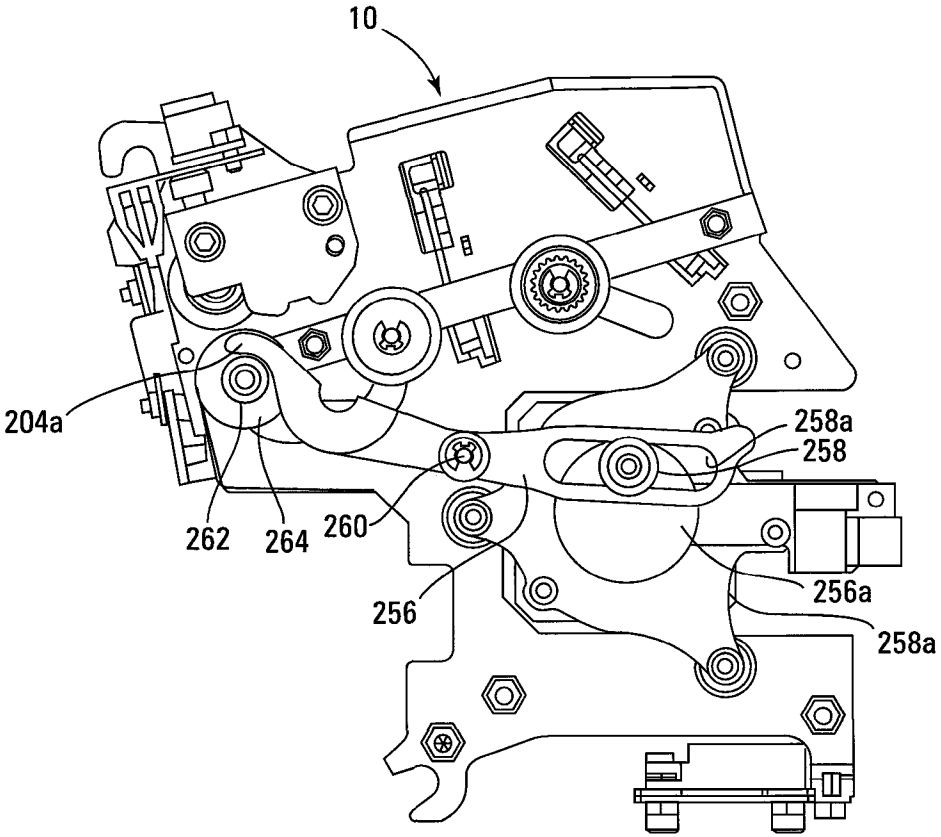
FIG. 11 shows a side view of an opened playing card input compartment with blocking finger elements in an unblocking position.

FIG. 11 shows a side view of a playing card input compartment 10 with blocking finger elements 204*a* in an unblocking position. One format for operation of the blocking finger elements 204*a* is for a motor 258*a* to drive arm 256 via cam 256*a* up and down, by engaging guide or roller 258 with a slot 258*a* in the arm 256. This causes a second arm portion 259 to articulate or rotate about pin 260, which in turns drives the blocking finger elements 204*a* against an axle 262 on forward drive wheel 264, causing the blocking finger elements 204*a* to rotate clockwise towards the slot 210 and block the slot 210, as shown in FIG. 8*a*.

Figure 12:
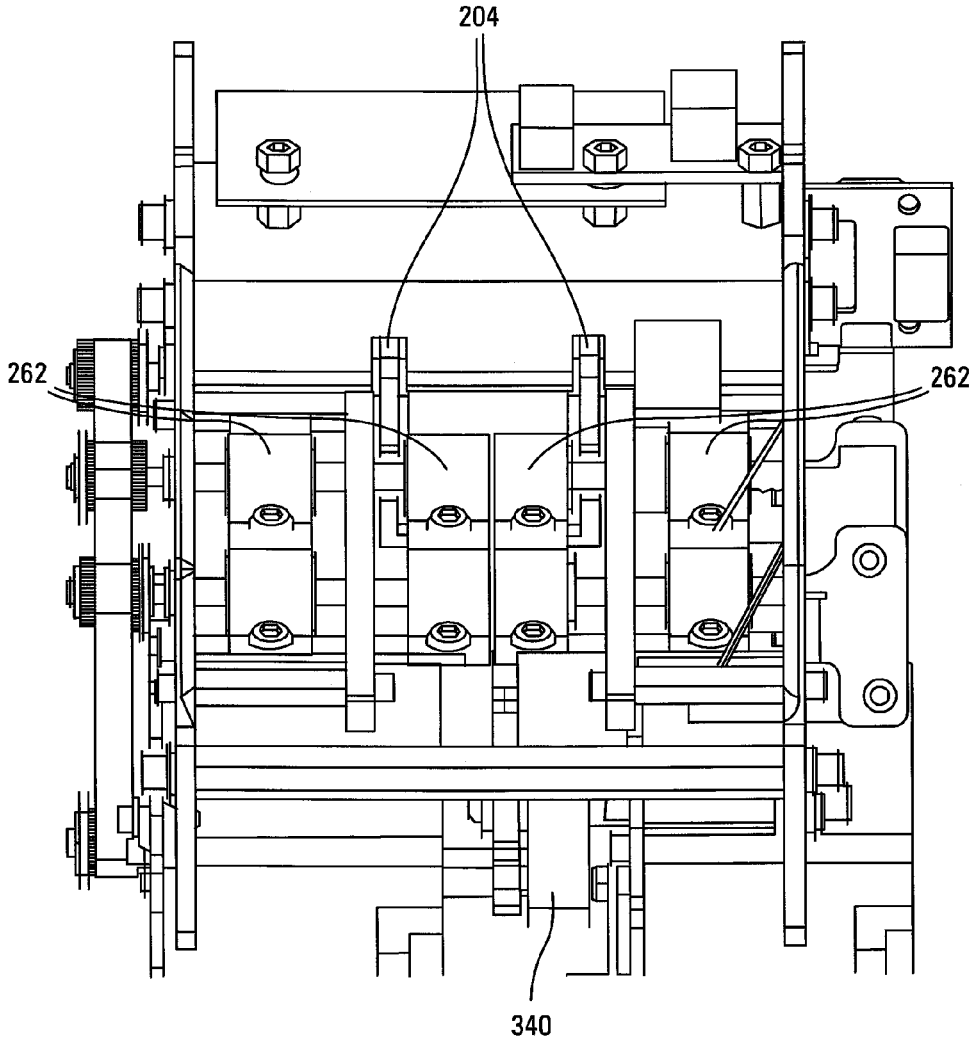
FIG. 12 shows a bottom exposed view of the playing card input compartment with the levers and the blocking finger elements shown in an unblocking position.

FIG. 12 shows a cutaway bottom end view of the playing card input compartment (not visible, as this is a bottom view) with the levers 204 with fingers shown in an unblocking position. Pick-off roller 340 is also shown.

Figure 13:
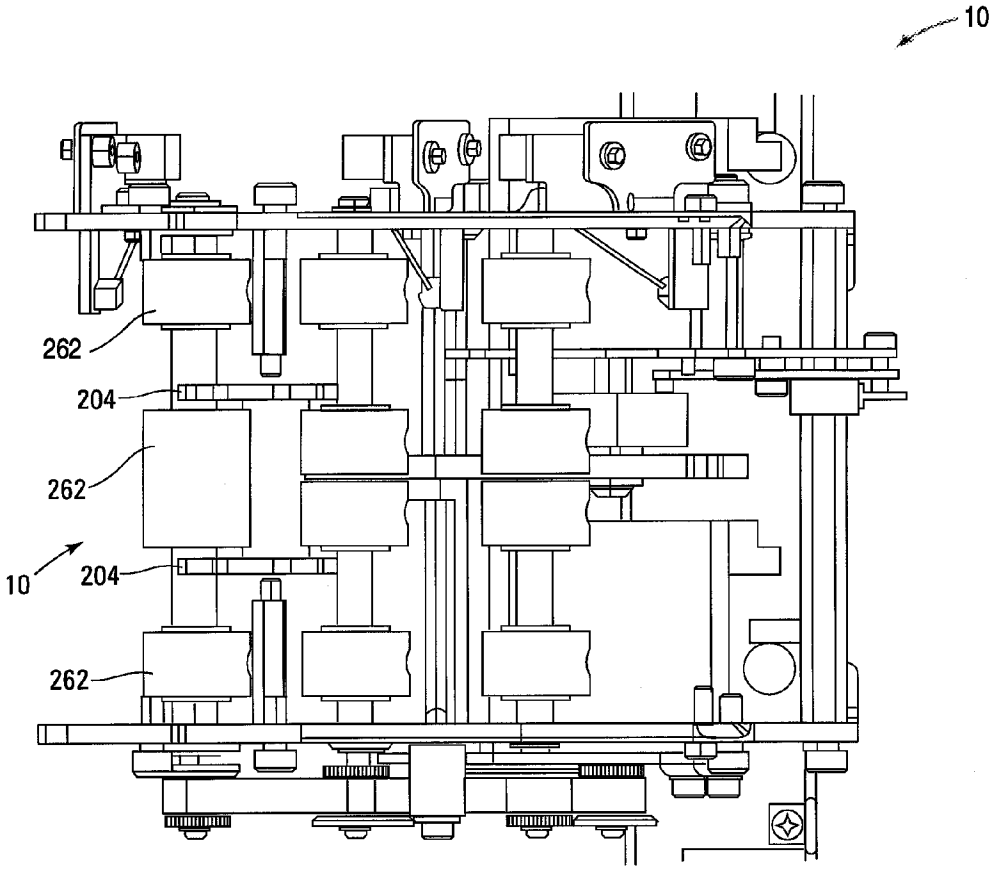
FIG. 13 shows a top exposed view of the playing card input compartment with the blocking finger elements shown in an unblocking position.

FIG. 13 shows a top view of the playing card input compartment 10 with the fingers 204 exposed. The fingers 204 are shown in an unblocking position adjacent the playing card-moving rollers 262.

The use of a gravity feed system, without sliding weights and without mechanical springs, glides or other forward moving or downward pressing weights and devices simplifies the manufacture and operation of the movement of playing cards within and out of the playing card input compartment. The use of slides, glides, rollers, weights and other mechanical devices also provides a basis for complications in the initial movement of cards out of the playing card input compartment by way of jamming or forcing multiple cards into or through the exit slot from the compartment. The sloped angle has been found to be important and even critical within the narrow defined range for the operation of the gravity feed system.

As repeatedly noted herein, although specific examples are shown for illustrative purposes, these specific examples are not intended to be limiting in the definition of the technology and inventions described herein, but are merely representative of specifics within the generic scope of the technology described.

What is claimed is:

1. A card handling apparatus comprising:

a card holding area, the card holding area having a lower support surface, and a front portion spaced apart from the lower support surface, the lower support surface and the front portion together defining a slot through which cards may be removed from the card holding area; and a blocking element located in the card holding area adjacent the slot, the blocking element configured and mounted in the card handling apparatus to, in a first position, prevent cards from moving from the card holding area through the slot and in a second position to allow cards to move from the card holding area through the slot.

2. The card handling apparatus of claim 1, wherein the card holding area is a card receiving well.

3. The card handling apparatus of claim 1, wherein the lower support surface is a declining surface that slopes downwardly towards the slot.

4. The card handling apparatus of claim 3, wherein the angle of the slope is between 12 and 22 degrees.

5. The card handling apparatus of claim 1, wherein the slot is substantially horizontal.

6. The card handling apparatus of claim 1, wherein the blocking element has a first end that is pivotally mounted to a frame, and a second opposite end that extends at least partially through the slot in the first position.

7. The card handling apparatus of claim 1, and further comprising a card moving mechanism within the card holding area that moves cards from within the card holding area, through the slot and out of the card holding area.

8. The card handling apparatus of claim 7, wherein the card moving mechanism moves cards individually.

9. The card handling apparatus of claim 7, wherein the card moving mechanism comprises at least one pick-off roller that contacts a card positioned within the card holding area and moves the card through the slot.

10. The card handling apparatus of claim 9, wherein the lower support surface comprises a base plate, and wherein the at least one pick-off roller extends at least partially through the base plate.

11. The card handling apparatus of claim 1, wherein an angle formed between the lower support surface and the front portion is no greater than 90 degrees.

12. The card handling apparatus of claim 11, wherein an angle formed between the lower support surface and the front portion is between about 68 and about 78 degrees.

13. The card handling apparatus of claim 1, wherein the blocking element is selected from the group consisting of a pin, a plate, a finger, a panel, and an arm.

* * * * *

UNITED STATES PATENT AND TRADEMARK OFFICE

CERTIFICATE OF CORRECTION

PATENT NO. : 8,844,931 B2
APPLICATION NO. : 14/042441
DATED : September 30, 2014
INVENTOR(S) : Ernst Blaha and Peter Krenn It is certified that error appears in the above-identified patent and that said Letters Patent is hereby corrected as shown below:

In the claims:

| | | | |
|---|---|---|---|
| CLAIM 3, | COLUMN 11, | LINE 29, | change “towards the slot.” to --toward the slot.-- |
| CLAIM 4, | COLUMN 11, | LINE 31, | change “between 12 and” to --between 12 degrees and-- |
| CLAIM 6, | COLUMN 12, | LINE 5, | change “second opposite” to --second, opposite-- |
| CLAIM 7, | COLUMN 12, | LINE 7, | change “claim **1**, and further” to --claim **1**, further-- |
| CLAIM 12, | COLUMN 12, | LINE 27, | change “about 68 and” to --about 68 degrees and-- |

Signed and Sealed this
Fourteenth Day of July, 2015

Michelle K. Lee

Michelle K. Lee
*Director of the United States Patent and Trademark Office*